US011242592B2

(12) United States Patent
Shimizu et al.

(10) Patent No.: US 11,242,592 B2
(45) Date of Patent: Feb. 8, 2022

(54) CONTINUOUS NITRIDING TREATMENT FURNACE AND CONTINUOUS NITRIDING TREATMENT METHOD

(71) Applicant: DOWA THERMOTECH CO., LTD., Tokyo (JP)

(72) Inventors: Katsushige Shimizu, Aichi (JP); Hokuto Hatanaka, Shiga (JP); Bin Sun, Shanghai (CN); Masakazu Kawahara, Tochigi (JP)

(73) Assignee: DOWA THERMOTECH CO., LTD., Tokyo (JP)

( * ) Notice: Subject to any disclaimer, the term of this patent is extended or adjusted under 35 U.S.C. 154(b) by 255 days.

(21) Appl. No.: 16/324,302

(22) PCT Filed: Sep. 27, 2017

(86) PCT No.: PCT/JP2017/034998

§ 371 (c)(1),
(2) Date: Feb. 8, 2019

(87) PCT Pub. No.: WO2018/062290

PCT Pub. Date: Apr. 5, 2018

(65) Prior Publication Data

US 2019/0177829 A1 Jun. 13, 2019

(30) Foreign Application Priority Data

Sep. 30, 2016 (JP) ..... JP2016-194241

(51) Int. Cl.

| | |
|---|---|
| ***C23C 8/26*** | (2006.01) |
| ***C22C 38/02*** | (2006.01) |
| ***C22C 38/04*** | (2006.01) |
| ***C22C 38/18*** | (2006.01) |
| ***C22C 38/00*** | (2006.01) |
| ***C21D 1/76*** | (2006.01) |
| ***C23C 8/02*** | (2006.01) |
| ***F27B 9/04*** | (2006.01) |
| ***C21D 9/32*** | (2006.01) |
| ***C23C 8/80*** | (2006.01) |
| *C21D 1/06* | (2006.01) |
| *C21D 11/00* | (2006.01) |
| *F27B 9/02* | (2006.01) |

(52) U.S. Cl.

CPC ..... *C23C 8/26* (2013.01); *C21D 1/76* (2013.01); *C21D 9/32* (2013.01); *C22C 38/00* (2013.01); *C22C 38/02* (2013.01); *C22C 38/04* (2013.01); *C22C 38/18* (2013.01); *C23C 8/02* (2013.01); *C23C 8/80* (2013.01); *F27B 9/04* (2013.01); *C21D 1/06* (2013.01); *C21D 11/00* (2013.01); *F27B 9/028* (2013.01); *F27B 9/045* (2013.01)

(58) Field of Classification Search

CPC .... C23C 8/26; C23C 8/24; C23C 8/02; C23C 8/80; C21D 1/06; C21D 1/76; C21D 11/00

See application file for complete search history.

(56) References Cited

U.S. PATENT DOCUMENTS

| | | | | |
|---|---|---|---|---|
| 5,273,585 | A * | 12/1993 | Shoga | C21D 1/74 118/719 |
| 5,871,806 | A | 2/1999 | Shoga et al. | |
| 2015/0038380 | A1 | 2/2015 | Nagamatsu et al. | |
| 2016/0244869 | A1 | 8/2016 | Shimizu et al. | |
| 2017/0138326 | A1 | 5/2017 | Paulus et al. | |

FOREIGN PATENT DOCUMENTS

| | | | |
|---|---|---|---|
| CN | 102168275 | A | 8/2011 |
| CN | 105593394 | A | 5/2016 |
| JP | 4-214852 | | 8/1992 |
| JP | 2013-227674 | | 11/2013 |
| JP | 2016-65263 | | 4/2016 |
| WO | 2015/046593 | | 4/2015 |
| WO | 2016005073 | A1 | 1/2016 |
| WO | 2016024923 | A1 | 2/2016 |

OTHER PUBLICATIONS

Chinese Office and Search Report, Chinese Patent Office, Application No. 201780037897.7, dated Mar. 24, 2020.

International Search Report in International Patent Application No. PCT/JP2017/034998, dated Nov. 14, 2017.

* cited by examiner

*Primary Examiner* — Jessee R Roe

(74) *Attorney, Agent, or Firm* — Greenblum & Bernstein, P.L.C.

(57) ABSTRACT

A continuous nitriding treatment furnace includes a nitriding chamber, a heater, a first nitriding zone, and a second nitriding zone lower in atmosphere gas temperature than the first nitriding zone by 25° C. to 150° C., the continuous nitriding treatment furnace being configured such that an atmosphere gas in the first nitriding zone flows into the second nitriding zone and being configured to execute a nitriding treatment that forms an iron nitride compound layer composed of an ε phase or of the ε phase and a γ' phase on a surface of the steel member in the first nitriding zone and precipitates the γ' phase in the iron nitride compound layer in the second nitriding zone.

14 Claims, 5 Drawing Sheets

CONTINUOUS NITRIDING TREATMENT FURNACE A

CONTINUOUS NITRIDING TREATMENT FURNACE B

CONTINUOUS NITRIDING TREATMENT FURNACE C

CONTINUOUS NITRIDING TREATMENT FURNACE D

CONTINUOUS NITRIDING TREATMENT FURNACE AND CONTINUOUS NITRIDING TREATMENT METHOD

TECHNICAL FIELD

The present invention relates to a continuous furnace where to apply a nitriding treatment to a steel member.

BACKGROUND ART

Steel members such as gears used in automobile transmissions are required to be high in pitting resistance and bending fatigue strength. As a method to meet such requirements, there has been known a method that applies a nitriding treatment to a steel member to form, on a surface of the steel member, an iron nitride compound layer including a γ' phase.

Patent Document 1 discloses a method that applies a 529 to 650° C. heat-treatment to a steel member under a $NH_3$ gas atmosphere to form an iron nitride compound layer on a surface of the steel member, then after once discharging the atmosphere gas in a process chamber, newly supplies an inert gas or a reducing gas, and performs a denitrification treatment by exposing the steel member having 500 to 650° C. to an atmosphere of the inert gas or the reducing gas for a predetermined time. In Patent Document 1, the iron nitride compound layer composed of an ε phase and a γ' phase is formed on the surface of the steel member by this method.

PRIOR ART DOCUMENT

Patent Document

Patent Document 1: Japanese Laid-open Patent Publication No. 2016-65263

SUMMARY OF THE INVENTION

Problems to be Solved by the Invention

The nitriding treatment of Patent Document 1 is performed in a batch-type furnace, but the batch-type furnace is low in productivity and its processable number per lot is limited, leading to an increase in treatment cost. Therefore, a series of the nitriding treatment is desirably performed continuously using a continuous furnace. However, in order to execute a nitriding treatment like that of Patent Document 1 in a continuous furnace including continuous process chambers, it is necessary to control the atmosphere gas independently in each of the process chambers, resulting in a complicated furnace structure.

The present invention was made in consideration of the above circumstances, and has an object to improve productivity of a nitrided steel member by performing a nitriding treatment in a continuous furnace, the nitriding treatment being a process that forms an iron nitride compound layer composed of an ε phase or of the ε phase and a γ' phase and thereafter precipitates the γ' phase in the iron nitride compound layer.

Means for Solving the Problems

The present inventors have found out that it is possible to perform the aforesaid nitriding treatment in the continuous furnace by controlling the temperature of an atmosphere gas in the furnace instead of controlling a nitriding potential KN of the atmosphere gas in the furnace. Specifically, the present invention to solve the aforesaid problem is a continuous nitriding treatment furnace where to apply a nitriding treatment to a steel member, the continuous nitriding treatment furnace including: a nitriding chamber into which the steel member is carried; a heater that heats an atmosphere gas in the nitriding chamber; and a control part that is configured to control an atmosphere gas temperature in the nitriding chamber, by adjusting a heat value of the heater so as to cause the nitriding chamber to have a first nitriding zone and a second nitriding zone whose atmosphere gas temperatures are different, the second nitriding zone being located downstream of the first nitriding zone in terms of a conveyor line and being lower in the atmosphere gas temperature than the first nitriding zone by 25° C. to 150° C., and that is configured to perform a control of executing the nitriding treatment that forms an iron nitride compound layer on a surface of the steel member in the first nitriding zone, by adjusting flow rates of gases included in a process gas for the nitriding treatment so as to attain a nitriding potential KN with which the iron nitride compound layer composed of an ε phase or of the ε phase and a γ' phase is formed on the surface of the steel member, and precipitates the γ' phase in the iron nitride compound layer in the second nitriding zone, wherein, when an atmosphere gas in the first nitriding zone flows into the second nitriding zone, a value calculated by subtracting the nitriding potential KN of the first nitriding zone from the nitriding potential KN of the second nitriding zone becomes −0.1 to 0. The nitriding potential KN is calculated by the following expression.

$$KN=P_{(NH3)}/P_{(H2)}^{3/2}$$

$P_{(NH3)}$: partial pressure of $NH_3$ gas, $P_{(H2)}$: partial pressure of $H_2$ gas The present invention according to another aspect s a continuous nitriding treatment method of applying a nitriding treatment to a steel member in a continuous furnace, the method including: controlling an atmosphere gas temperature in a nitriding chamber into which the steel member is carried, so as to cause the nitriding chamber to have a first nitriding zone and a second nitriding zone whose atmosphere gas temperatures are different, the second nitriding zone being located downstream of the first nitriding zone in terms of a conveyor line and being lower in the atmosphere gas temperature than the first nitriding zone by 25° C. to 150° C.; and performing the nitriding treatment that: forms an iron nitride compound layer on a surface of the steel member in the first nitriding zone to which a process gas for the nitriding treatment has been supplied, with gases included in the process gas being adjusted in flow rates so as to attain a nitriding potential KN with which the iron nitride compound layer composed of an ε phase or of the ε phase and a γ' phase is formed on the surface of the steel member; and precipitates the γ' phase in the iron nitride compound layer in the second nitriding zone configured such that a value calculated by subtracting the nitriding potential KN of the first nitriding zone from the nitriding potential KN of the second nitriding zone becomes −0.1 to 0 when an atmosphere gas in the first nitriding zone flows into the second nitriding zone.

Effect of the Invention

According to the present invention, the nitriding treatment that forms the iron nitride compound layer composed of the ε phase or of the ε phase and the γ' phase and thereafter precipitates the γ' phase in the iron nitrided compound layer can be performed in the continuous furnace. This makes it possible to improve productivity of a nitrided steel member.

MODES FOR CARRYING OUT INVENTION

An embodiment of the present invention will be hereinafter described with reference to the drawings. In this specification and the drawings, elements having substantially the same functional configuration are denoted by the same reference signs to avoid redundant description.

Figure 1:
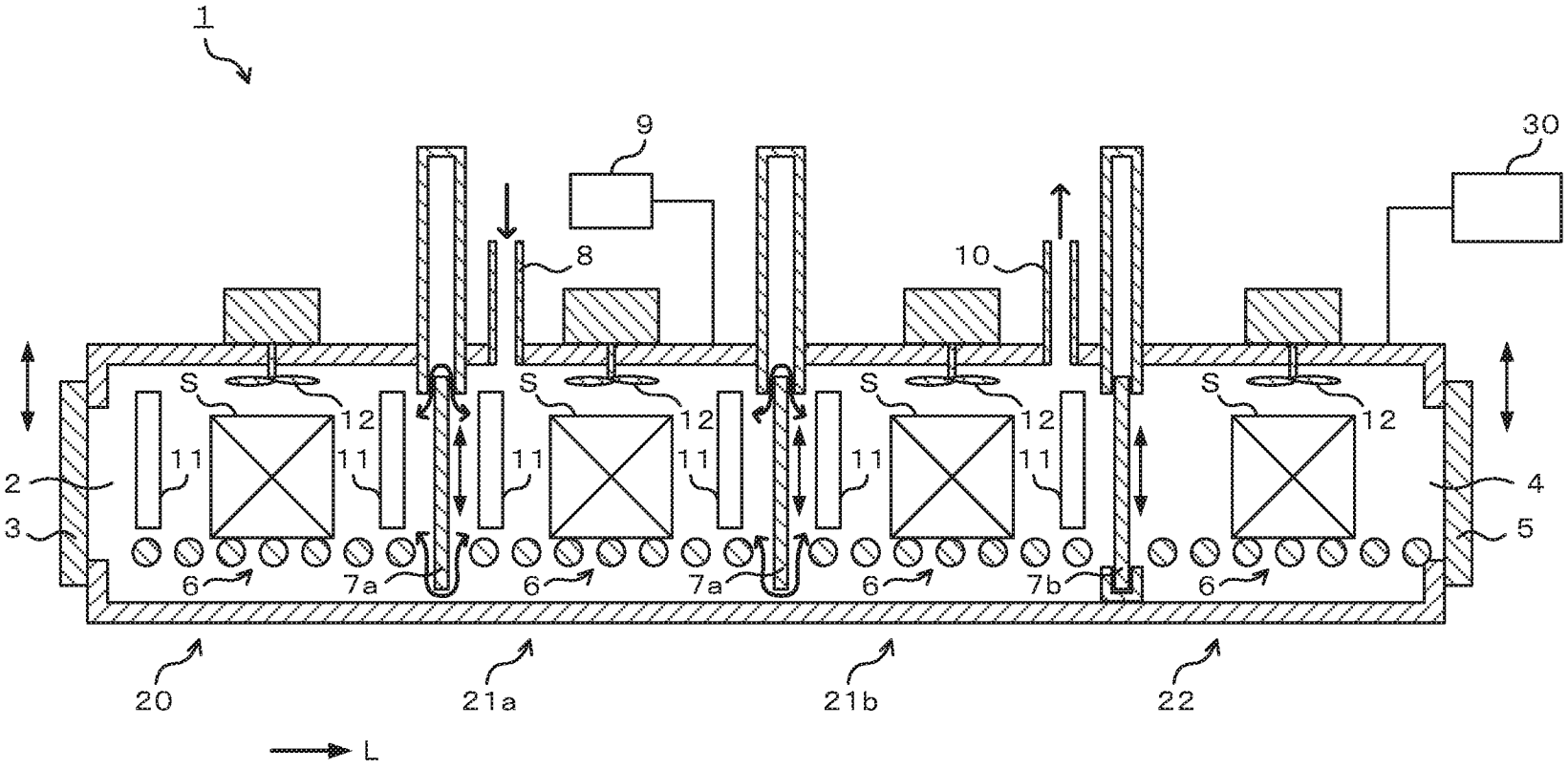
FIG. 1 is a view illustrating a schematic configuration of a continuous nitriding treatment furnace according to an embodiment of the present invention.

As illustrated in FIG. 1, a continuous nitriding treatment furnace 1 according to this embodiment has a plurality of process chambers, and includes, in order from an upstream side of a conveyor line L, a heating chamber in which a steel member S is heated, a first nitriding chamber 21*a* in which an iron nitride compound layer is formed on a surface of the steel member S, a second nitriding chamber 21*b* in which a γ' phase is precipitated in the iron nitride compound layer of the steel member S, a cooling chamber 22 in which the steel member S is cooled, and a control part 30 that controls operation states of the furnace. The composition of the steel member S is not limited, and mechanical structural steel such as S25C, S35C, S45C, SCM415, SCM420, SCM435, or SACM645 is usable, for instance. The steel member is placed on a specialized jig when conveyed, but in FIG. 1, it is referred to as the steel member S for convenience' sake.

In an upstream-side furnace wall of the heating chamber 20 in terms of the conveyor line, a carry-in port 2 through which the steel member S is carried in is formed, and a carry-in door 3 openable/closable in an up/down direction is provided on an outer surface of the furnace wall to insulate atmosphere gases inside and outside the furnace from each other. In a downstream-side furnace wall of the cooling chamber 22 in terms of the conveyor line, a carry-out port 4 through which the steel member S is carried out is formed, and an carry-out door 5 (Tenable/closable in the up/down direction is provided on an outer surface of the furnace wall to insulate the atmosphere gases inside and outside the furnace from each other. A roller hearth 6 for conveying the steel member S is provided on a hearth, and the steel member S carried into the furnace through the carry-in port 2 passes through the process chambers, namely, the heating chamber 20, the first nitriding chamber 21*a*, the second nitriding chamber 21*b*, and the cooling chamber 22 to be carried out of the furnace through the carry-out port 4.

Between the heating chamber 20 and the first nitriding chamber 21*a* and between the first nitriding chamber 21*a* and the second nitriding chamber 21*b*, partition doors 7*a* openable/closable in the up/down direction are provided to separate the atmosphere gases of the adjacent process chambers. The partition doors 7*a* are not structured to strictly separate the atmosphere gases in the adjacent process chambers but is structured to allow the atmosphere gases in the adjacent process chambers to flow into each other through spaces above the partition doors 7*a*, spaces of the roller hearth 6 under the partition doors 7*a*, and so on as indicated by the arrows in FIG. 1 when the partition doors 7*a* are closed. Further, between the second nitriding chamber 21*b* and the cooling chamber 22, a partition door 7*b* openable/closable in the up/down direction is also provided to separate the atmosphere gases of the process chambers from each other. The partition door 7*b* is structured not to allow the atmosphere gases in the adjacent process chambers to easily flow into each other, unlike the aforesaid partition doors 7*a*.

A process gas supply pipe 8 through which a process gas for a nitriding treatment is supplied is provided to the first nitriding chamber 21*a*. The process gas for the nitriding treatment in this embodiment (hereinafter, "process gas") is composed of a $NH_3$ gas and a $H_2$ gas. The process gas supply pipe 8 connects to a ceiling portion near the heating chamber, in the first nitriding chamber 21*a*. A gas analyzer 9 that measures a partial pressure of the atmosphere gas is further provided to the first nitriding chamber 21*a*. The gas analyzer 9 is configured to be capable of measuring partial pressures of the gasses included in the process gas supplied into the first nitriding chamber 21*a*, that is, partial pressures of the $NH_3$ gas and the $H_2$ gas. The connection position of the process gas supply pipe 8 to the first nitriding chamber 21*a* is not limited to the position shown in this embodiment, but may be any position as long as the process gas can sufficiently diffuse in the first nitriding chamber 21*a* from the position.

In a ceiling portion of the second nitriding chamber 21*b*, an exhaust pipe 10 through which the atmosphere gas in the furnace is discharged is provided. The exhaust pipe 10 connects to the ceiling portion near the cooling chamber, in the second nitriding chamber 21*b*. It should be noted that the connection position of the exhaust pipe 10 to the second nitriding chamber 21*b* is not limited to the position shown in this embodiment, but may be any position as long as the discharge pipe 10 does not obstruct the atmosphere gas flowing from the inside of the first nitriding chamber 21 from sufficiently diffusing into the second nitriding chamber 21*b*.

As described above, the continuous nitriding treatment furnace 1 of this embodiment is configured such that the atmosphere gases in the first nitriding chamber 21*a* and the second nitriding chamber 21*b* are not strictly insulated from each other, and further the process gas supply pipe 8 connects to the first nitriding chamber 21*a* and the exhaust pipe 10 connects to the second nitriding chamber 21*b*, which makes the atmosphere gas in the first nitriding chamber 21*a* easily flow into the second nitriding chamber 21*b*. Incidentally, between the heating chamber 20 and the first nitriding chamber 21*a*, the atmosphere gas easily flows from the first nitriding chamber 21*a* toward the heating chamber 20 since the process gas supply pipe 8 is provided to the first nitriding chamber 21*a*. This makes a nitriding potential KN of the heating chamber 20 and a nitriding potential KN of the first nitriding chamber 21*a* substantially equal to each other when the carry-in door 3 and the partition doors 7*a* are closed.

The heating chamber 20, the first nitriding chamber 21*a*, and the second nitriding chamber 21*b* each have heaters 11 that adjust an atmosphere gas temperature in the process chamber. Further, the heating chamber 20, the first nitriding chamber 21*a*, the second nitriding chamber 21*b*, and the cooling chamber 22 each have a stirring fan 12 that stirs the atmosphere gas in the process chamber to unify the atmosphere gas in the process chamber and unify the temperature of the steel member S.

The control part 30 is configured to control the opening/closing timings of the carry-in door 3, the carry-out door 5, and the partition doors 7*a*, 7*b*, control the conveyance speed of the steel member S, control the rotation speed of the stirring fans 12, control heat values of the heaters 11 based on the atmosphere gas temperatures in the process chambers, and control flow rates of the gasses included in the process gas based on the nitriding potential KN calculated from the partial pressures of the gasses included in the process gas in the first nitriding chamber 21*a* as measured by the gas analyzer 9. The control part 30 further controls the atmosphere gas temperature in the second nitriding chamber 21*b* to a temperature lower than the atmosphere gas temperature in the first nitriding chamber 21*a* by 25° C., to 150° C.' by adjusting the heat values of the heaters 11. Under the above controls, the nitriding treatment that forms the iron nitride compound layer on the surface of the steel member S in the first nitriding chamber 21*a* and precipitates the γ' phase in the iron nitride compound layer in the second nitriding chamber 21*b* is executed. The configuration of a control system of the control part 30 is not limited, and for example, a plurality of control systems may independently perform the aforesaid controls respectively, or one control system may centrally control the aforesaid controls.

Figure 2:
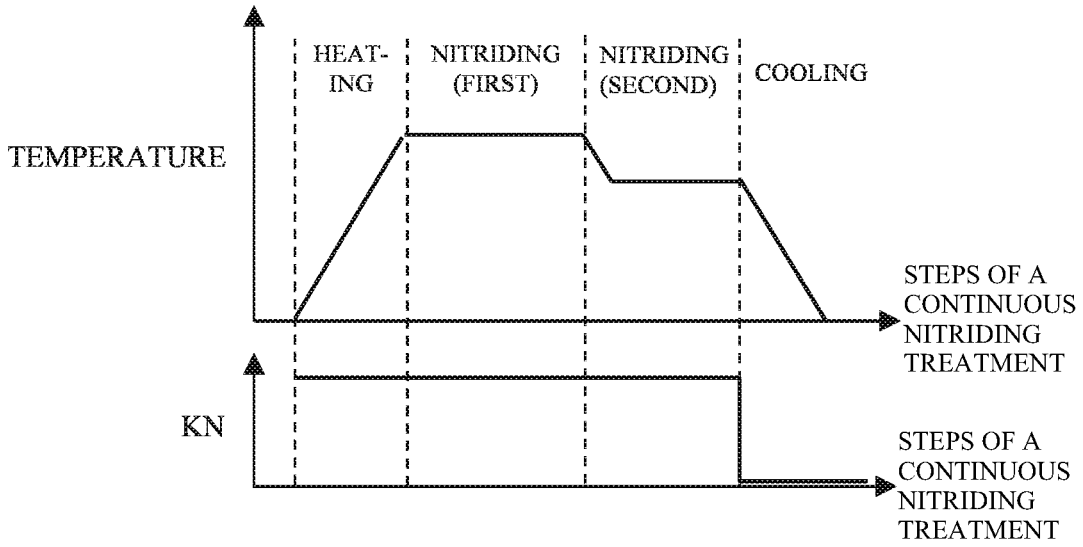
FIG. 2 is a chart roughly illustrating a temperature history of a steel member and a history of a nitriding potential. KN in process chambers, in steps of a continuous nitriding treatment according to the embodiment of the present invention.

The continuous nitriding treatment furnace 1 according to this embodiment is configured as described above. Next, a continuous nitriding treatment method using the continuous nitriding treatment furnace 1 will be described with reference to FIG. 1 and FIG. 2. In the continuous nitriding treatment furnace 1 of this embodiment, the treatments in the respective process chambers are started, with the carry-in door 3, the carry-out door 5, and the partition doors 7*a*, 7*b* being closed, then after a predetermined time passes, the carry-in door 3, the carry-out door 5, and the partition doors 7*a*, 7*b* are opened, and the steel member S is carried to the next process chamber. Hereinafter, treatment steps will be sequentially described. FIG. 2 is a chart roughly illustrating a temperature history of the steel member S and a history of the nitriding potential KN in the process chambers, in the steps of the continuous nitriding treatment of this embodiment.

First, the steel member S is carried into the heating chamber 20. The heating chamber 20 is kept at an atmosphere gas temperature equal to the atmosphere gas temperature in the first nitriding chamber 21*a*. The steel member S is heated in the heating chamber 20 up to a temperature for the nitriding treatment.

Subsequently, the steel member S is carried into the first nitriding chamber 21*a*. Here, the $NH_3$ gas and the $H_2$ gas have been supplied through the process gas supply pipe 8, and the atmosphere gas in the first nitriding chamber 21*a* has been in a state of having a nitriding potential KN with which the iron nitride compound layer is formed on the surface of the steel member S. When the steel member S is exposed to such a nitriding atmosphere, the surface of the steel member S is nitrided and the iron nitride compound layer composed of an ε phase or of the ε phase and the γ' phase is formed on the surface of the steel member S.

The atmosphere gas temperature in the first nitriding chamber 21*a* is preferably 550 to 625° C. If the atmosphere gas temperature in the first nitriding chamber 21*a* is lower than 550° C., the generation speed of the iron nitride compound layer may become low. On the other hand, when the atmosphere gas temperature in the first nitriding chamber 21*a* is higher than 625° C., the softening and strain of the steel member S may increase. Further, the nitriding potential KN of the atmosphere gas in the first nitriding chamber 21*a* is preferably 0.25 to 1.0. If the nitriding potential KN is lower than 0.25, the generation speed of the iron nitride compound layer may become very low or the iron nitride compound layer itself may not be generated.

Subsequently, the steel member S having the iron nitride compound layer formed thereon is carried to the second nitriding chamber 211 which is lower in the atmosphere gas temperature than the first nitriding chamber 21*a*. At this time, since the second nitriding chamber 21*b* is relatively lower in the atmosphere gas temperature than the first nitriding chamber 21*a*, the decomposition rate of the $NH_3$ gas supplied as the process gas is lower in the second nitriding chamber 21*b* than in the first nitriding chamber 21*a*. This makes the $NH_3$ gas more difficult to decrease and the $H_2$, gas more difficult to increase in the second nitriding chamber 21*b* than in the first nitriding chamber 21*a*. Further, even while the partition door 7*a* between the first nitriding chamber 21*a* and the second nitriding chamber 21*b* is closed, the inside of the second nitriding chamber 21*b* is in a state where the atmosphere gas of the first nitriding chamber 21*a* flows thereto through the space between the partition door 7*a* and the furnace wall. Accordingly, the atmosphere gases are exchanged between the first nitriding chamber 21*a* and the second nitriding chamber 21*b*.

Consequently, when the furnace is put into operation and the states of the process chambers become stable, the partial pressure of the $NH_3$ gas in the second nitriding chamber 21*b* becomes equal to or lower than the partial pressure of the $NH_3$ gas in the first nitriding chamber 21*a*, and the partial pressure of the $H_2$ gas in the second nitriding chamber 21*b* becomes equal to or more than the partial pressure of the $H_2$ gas in the first nitriding chamber 21*a*. As a result, the nitriding potential KN of the second nitriding chamber 21*b* becomes equal to or lower than the nitriding potential KN of the first nitriding chamber 21*a*, and a value calculated by subtracting the nitriding potential KN of the first nitriding chamber 21*a* from the nitriding potential KN of the second nitriding chamber 21*b* becomes −0.1 to 0. Thus, the nitriding potential KN of the second nitriding chamber 21*b* is naturally determined by the nitriding potential KN of the first nitriding chamber 21*a*. In particular, in this embodiment, since the exhaust pipe 10 connects to the second nitriding chamber 21*b*, the atmosphere gas in the first nitriding chamber 21*a* easily flows into the second nitriding chamber 21*b*, and the value calculated by subtracting the nitriding potential KN of the first nitriding chamber 21*a* from the nitriding potential KN of the second nitriding chamber 21*b* easily becomes −0.1 to 0. Incidentally, between the heating chamber 20 and the first nitriding chamber 21*a* as well, the atmosphere gas in the first nitriding chamber 21*a* flows toward the heating chamber 20 through the space around the partition door 7*a*. Accordingly, the heating chamber 20 and the first nitriding chamber 21*a* are substantially equal in the nitriding potential KN as illustrated in FIG. 2.

Further, the atmosphere gas temperature in the second nitriding chamber 21*b* is preferably 475 to 550° C. If the atmosphere gas temperature in the second nitriding chamber 21*b* is lower than 475° C., the precipitation of the γ' phase may become slow, requiring a long treatment time. On the other hand, if the atmosphere gas temperature the second nitriding chamber 21*b* is higher than 550° C., a fraction of the γ' phase becomes low. Further, a difference by which the atmosphere gas temperature in the second nitriding chamber 21*b* is lower than the atmosphere gas temperature in the first nitriding chamber 21*a* is preferably 25° C. to 150° C. If the temperature difference between the atmosphere gases in the first nitriding chamber 21*a* and the second nitriding chamber 21*b* is less than 25° C., the precipitation of the γ' phase may be difficult to occur in the second nitriding chamber 21*b*. On the other hand, if the temperature difference between the atmosphere gases in the first nitriding chamber 21*a* and the second nitriding chamber 21*b* is over 150° C., at least one of an increase in the softening and strain of the steel member S due to the too high atmosphere gas temperature in the first nitriding chamber 21*a* and a delay in the precipitation of the γ' phase due to the too low atmosphere gas temperature in the second nitriding chamber 21*b* may occur.

Since the atmosphere gas in the second nitriding chamber 21*b* has such a nitriding potential KN that the value calculated by subtracting the nitriding potential KN of the first nitriding chamber 21*a* from the nitriding potential KN of the second nitriding chamber 21*b* becomes −0.1 to 0 and the second nitriding chamber 21*b* is lower in the atmosphere gas temperature than the first nitriding chamber 21*a* as described above, a ratio of the γ' phase which is a low-temperature stable phase increases in the iron nitride compound layer, making it possible to obtain a nitrided steel member excellent in pitting resistance and fatigue strength.

The steel member S in which the ratio of the γ' phase has increased in the second nitriding chamber 21*b* is carried to the cooling chamber 22 to be cooled to a predetermined temperature. Thereafter, the steel member S is carried out of the furnace. This is the completion of the series of the nitriding treatment using the continuous nitriding treatment furnace 1.

As described above, the continuous nitriding treatment furnace 1 of this embodiment has a furnace structure such that the atmosphere gas temperature in the second nitriding chamber 21*b* is lower than the atmosphere gas temperature in the first nitriding chamber 21*a*, the atmosphere gas in the first nitriding chamber 21*a* flows into the second nitriding chamber 21*b*, and the nitriding potential KN of the second nitriding chamber 21*b* is dependent on that of the first nitriding chamber 21*a*. This structure makes it possible for the nitriding treatment that precipitates the γ' phase in the iron nitride compound layer to be performed in the continuous furnace. This enables an increase in productivity of the nitrided steel member and a decrease in the treatment cost.

Incidentally, in this embodiment, the heating chamber 20, the first nitriding chamber 21*a*, the second nitriding chamber 21*b*, and the cooling chamber 22 are provided as the process chambers configuring the continuous nitriding treatment furnace 1, but the configuration of the process chambers is not limited to this. The configuration of the process chambers can be appropriately changed to a degree not inhibiting the nitriding treatment by the first nitriding chamber 21*a* and the second nitriding chamber 21*b* described in this embodiment.

Further, in this embodiment, the process gas for the nitriding treatment is composed of the $NH_3$ gas and the $H_2$ gas, but the process gas for the nitriding treatment may include an inert gas such as, for example, a $N_2$ gas in addition to the $NH_3$ gas and the $H_2$ gas. That is, the supply of another gas in an amount not inhibiting the nitriding treatment of this embodiment in addition to the $NH_3$ gas and the $H_2$ gas is permitted. In the case where the the $NH_3$ gas, the $H_2$ gas, and the $N_2$, gas are supplied, it is preferable to supply the $N_2$ gas so as to be capable of maintaining a state where the partial pressure ratio of the $NH_3$ gas in the atmosphere gas becomes 0.1 or more.

Figure 3:
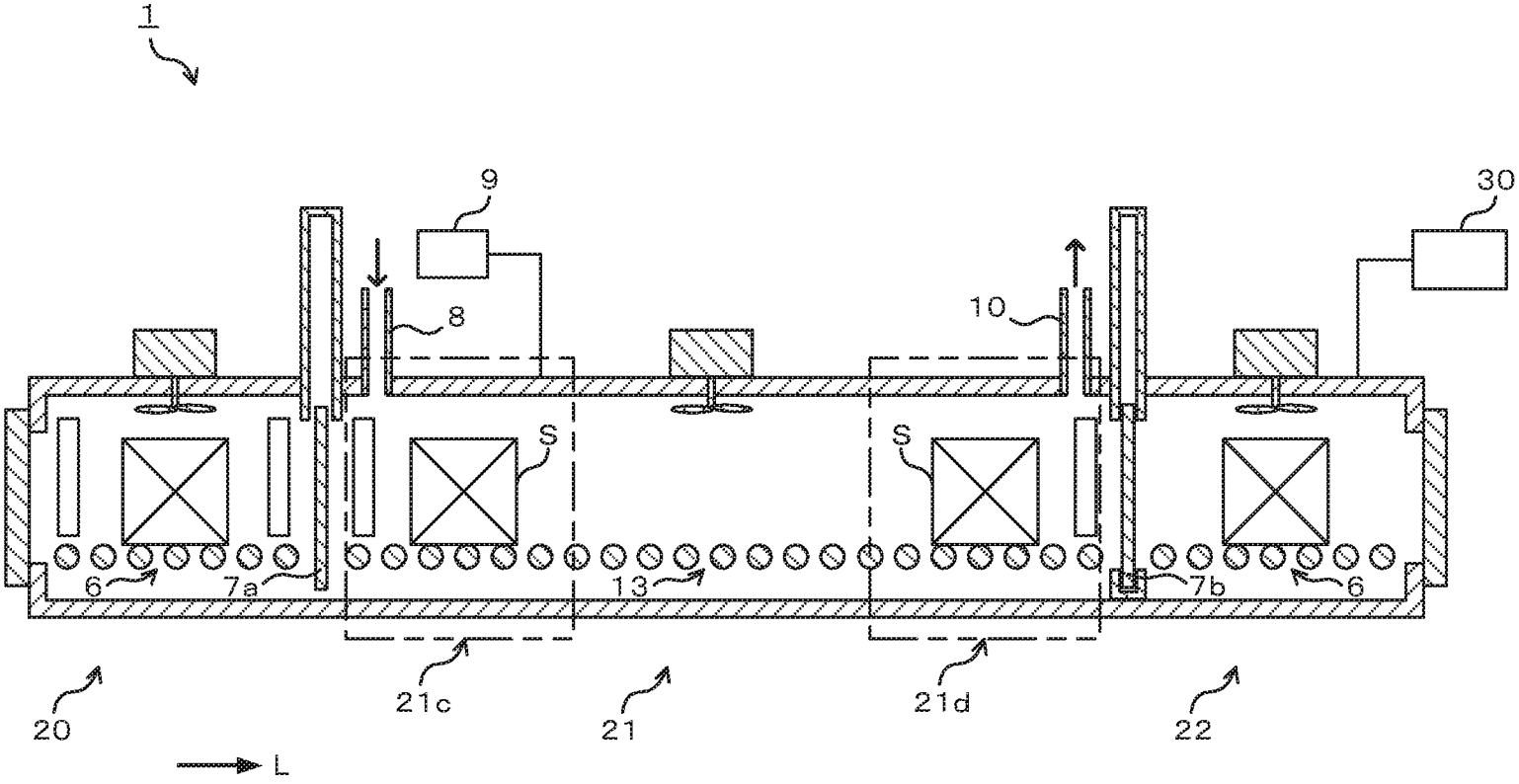
FIG. 3 is a view illustrating a schematic configuration of a continuous nitriding treatment furnace according to another embodiment of the present invention.

Further, in this embodiment, the nitriding chamber 21 is divided by the partition door 7*a* into the different process chambers, namely, "the first nitriding chamber 21*a*" and "the second nitriding chamber 21*b*", but in a case where the total length of the nitriding chamber 21 is long as in, for instance, FIG. 3, by providing regions different in the atmosphere gas temperature in the same nitriding chamber 21, it is possible to perform the same nitriding treatment as that in the above-described embodiment. Specifically, the heat values of the heaters 11 are controlled so as to form a first nitriding zone 21*c* and a second nitriding zone 21*d* located downstream of the first nitriding zone 21*c* in terms of the conveyor line and lower in the atmosphere gas temperature than the first nitriding zone 21*c* by 25° C. to 150° C., as the regions different in the atmosphere gas temperature in the nitriding chamber. Consequently, the second nitriding zone 21*d* has such an atmosphere gas that a value calculated by subtracting the nitriding potential KN of the first nitriding zone 21*c* from the nitriding potential KN of the second nitriding zone 21*d* becomes −0.1 to 0. Further, the process gas supply pipe 8 through which the $NH_3$ gas and the $H_2$ gas are supplied is provided at a position corresponding to the first nitriding zone 21*c*, and the exhaust pipe 10 through which the atmosphere gas in the furnace is discharged is provided at a position corresponding to the second nitriding zone 21*d*. Further, in the case of the furnace illustrated in FIG. 3, only a roller hearth 13 of the nitriding chamber 21 is configured to operate independently of the roller hearths 6 of the other process chambers, for instance.

In the case where such a continuous nitriding treatment furnace 1 is used, on the surface of the steel member S carried to the first nitriding zone 21*c*, the iron nitride compound layer composed of the ε phase or of the ε phase and the γ phase is formed in the first nitriding zone 21*c*, and thereafter, the steel member S is carried straight to the second nitriding zone 21*d*. Consequently, in the second nitriding zone 21*d*, the steel member S is exposed to such an atmosphere gas that the value calculated by subtracting the nitriding potential KN of the first nitriding zone 21*c* from the nitriding potential KN of the second nitriding zone 21*d* becomes −0.1 to 0 and that is lower in the atmosphere gas temperature than in the first nitriding zone 21*a* by 25° C. to 150° C., resulting in an increase in the phase which is the low-temperature stable phase. However, providing the partition door 7*a* between the first nitriding zone 21*c* and the second nitriding zone 21*d* to provide the nitriding zones as different process chambers as described in the previous embodiment permits the regions different in the atmosphere gas temperature to be more close to each other, making it possible to shorten the total length of the furnace.

Further, in the above-described embodiment, the partition door 7*a* is provided between the heating chamber 20 and the first nitriding chamber 21*a*, and this partition door 7*a* is intended to prevent the atmosphere gas temperature in the first nitriding chamber 21*a* from decreasing. Accordingly, the partition door 7*a* between the heating chamber 20 and the first nitriding chamber 21*a* may not be provided, as long as an influence that the decrease in the atmosphere gas temperature in the first nitriding chamber 21*a* has on the quality of the nitrided steel member is on a permissible level.

Further, in the above-described embodiment, the exhaust pipe 10 through which the atmosphere gas in the furnace is discharged is provided only to the second nitriding chamber 21*b*, but it may be further provided to the heating chamber 20 in addition to the second nitriding chamber 21*b*. This makes the atmosphere gas in the first nitriding chamber 21*a* easily flow into the heating chamber 20, which facilitates filling the heating chamber 20 with the same atmosphere gas as that in the first nitriding chamber 21*a*. As a result, when the steel member S is carried to the first nitriding chamber 21*a*, a change in the atmosphere gas in the first nitriding chamber 21*a* becomes small, making it possible to reduce quality variation of the nitriding treatment. Incidentally, in a case where the partition door 7*a* is not provided between the heating chamber 20 and the first nitriding chamber 21*a*, a structure in which an exhaust pipe is provided to a heating zone (not illustrated) provided upstream of the first nitriding zone in terms of the conveyor line makes it possible to obtain the same effect. Further, a supply mechanism for supplying the process gas into the nitriding chamber and an exhaust mechanism for discharging the atmosphere gas in the furnace are not limited to the structures described in the previous embodiments.

Hitherto, the embodiments of the present invention have been described, but the present invention is not limited to these examples, and it is obvious that various changed examples or modified examples within the range of the technical idea described in the claims could occur to those skilled in the art, and these are also naturally understood as would fall within the technical scope of the present invention.

EXAMPLES

Steel members prepared as test pieces were subjected to a nitriding treatment using the continuous nitriding treatment furnace according to the present invention, and iron nitride compound layers of obtained nitrided steel members were evaluated. The composition of the steel members prepared as the test pieces is as shown in the following Table 1.

TABLE 1

| CHEMICAL COMPOSITION (mass %) | | | | |
|---|---|---|---|---|
| C | Si | Mn | Cr | Fe |
| 0.095 | 0.2 | 0.9 | 1.4 | BALANCE |

Figure 4:
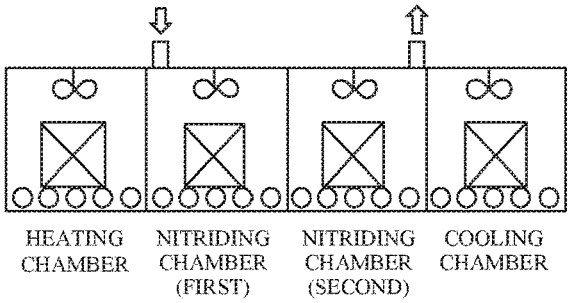
FIG. 4 is a view illustrating the structure of a continuous nitriding treatment furnace A according to an example of the present invention.
Figure 5:
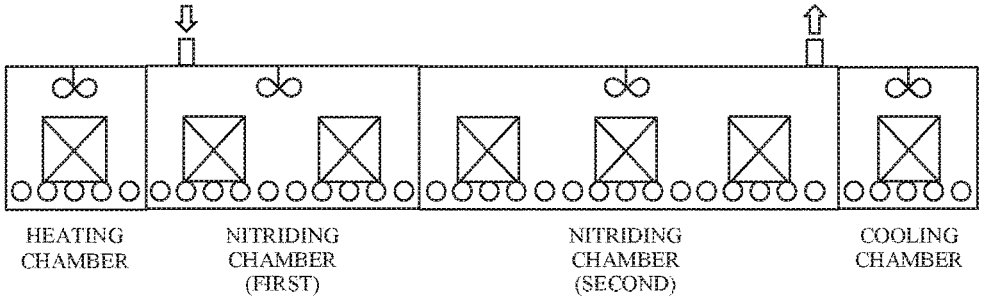
FIG. 5 is a view illustrating the structure of a continuous nitriding treatment furnace B according to an example of the present invention.
Figure 6:
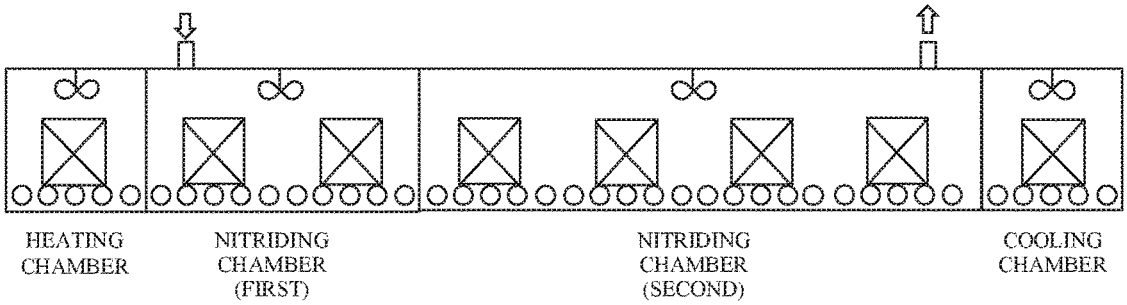
FIG. 6 is a view illustrating the structure of a continuous nitriding treatment furnace C according to an example of the present invention.
Figure 7:
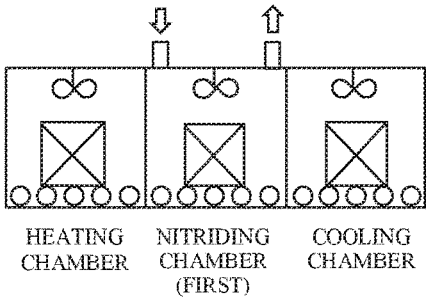
FIG. 7 is a view illustrating the structure of a continuous nitriding treatment furnace D according to a comparative example.

As the continuous nitriding treatment furnace according to the present invention, three kinds of furnaces different in length of a process chamber as illustrated in FIG. 4 to FIG. 6 were used. Further, as a comparative example, a continuous nitriding treatment furnace without a second nitriding chamber as illustrated in FIG. 7 was also used. In these examples, the furnace having the structure illustrated in FIG. 4 is referred to as a continuous nitriding treatment furnace A, the furnace having the structure in FIG. 5 as a continuous nitriding treatment furnace B, the furnace having the structure illustrated in FIG. 6 as a continuous nitriding treatment furnace C, and the furnace having the structure illustrated in FIG. 7 as a continuous nitriding treatment furnace D. Note that FIG. 4 to FIG. 7 each schematically illustrate the structure of the furnace in order to explain the structures of process chambers, but the furnaces each include the heaters, the gas analyzer, the control part, and so on illustrated in FIG. 1. That is, in each of the furnaces, the opening/closing timings of the carry-in door and the carry-out door, the opening/closing timings of the partition doors, the conveyance speed of the steel member, the rotation speed of the stirring fans, the heat values of the heaters, the flow rates of the gasses included in the process gas for the nitriding treatment based on the nitriding potential KN of the nitriding chamber (the first nitriding chamber in the continuous nitriding treatment furnaces A to C) are controlled.

In the continuous nitriding treatment furnace A, the test piece placed on a jig moves downstream in terms of the conveyor line by a distance corresponding to one jig in a sixty minute cycle. That is, in the continuous nitriding treatment furnace A, the test piece carried into the furnace is carried out of the furnace after kept in the heating chamber for sixty minutes, in the first nitriding chamber for sixty minutes, in the second nitriding chamber for sixty minutes, and in the cooling chamber for sixty minutes. In the continuous nitriding treatment furnaces B, C, the test piece placed on a jig moves downstream in terms of the conveyor line by a distance corresponding to one jig in a thirty minute cycle. That is, in the continuous nitriding treatment furnace B, the test piece carried into the furnace is carried out of the furnace after kept in the heating chamber for thirty minutes, in the first nitriding chamber for sixty minutes, in the second nitriding chamber for ninety minutes, and in the cooling chamber for thirty minutes. In the continuous nitriding treatment furnace C, the test piece carried into the furnace is carried out of the furnace after kept in the heating chamber for thirty minutes, in the first nitriding chamber for sixty minutes, in the second nitriding chamber for 120 minutes, and in the cooling chamber for thirty minutes. In the continuous nitriding treatment furnace D, the test piece placed on a jig moves downstream in terms of the conveyor line by a distance corresponding to one jig in a sixty minute cycle. That is, in the continuous nitriding treatment furnace D, the test piece carried into the furnace is carried out of the furnace after kept in the heating chamber for sixty minutes, in the nitriding chamber for sixty minutes, and in the cooling chamber for sixty minutes.

Figure 8:
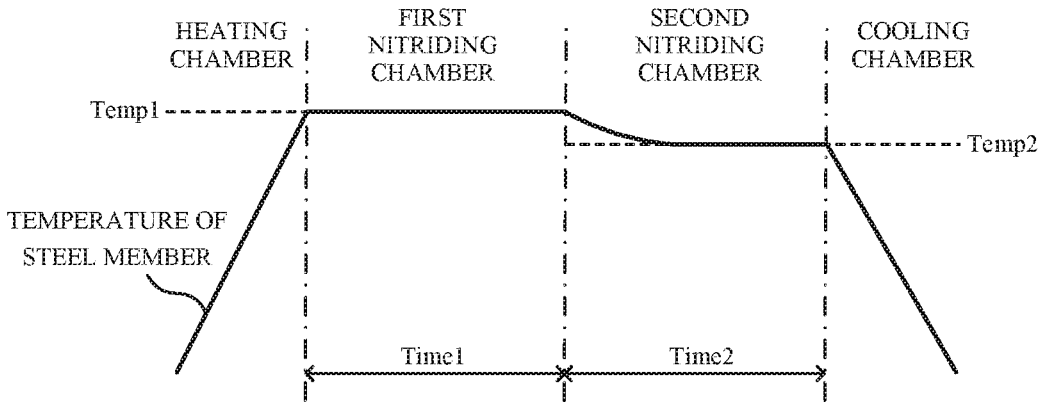
FIG. 8 is a chart illustrating treatment conditions and test results of a nitriding treatment test.

Treatment conditions of the continuous nitriding treatment are as shown in later-described Table 2. What [Temp1], [Temp2], [Time1], and [Time2] in Table 2 mean will be explained with reference to FIG. 8. [Temp1] is an atmosphere gas temperature in the heating chamber and the first nitriding chamber. The test piece carried into the furnace is heated up to the temperature Temp1, and is subjected to the nitriding treatment in the first nitriding chamber while kept at this temperature. [Temp2] is an atmosphere gas temperature in the second nitriding chamber. In the test piece on whose surface the iron nitride compound layer has been formed in the first nitriding chamber, the precipitation of the γ' phase is promoted in the second nitriding chamber. [Time1] is a treatment time in the first nitriding chamber. [Time2] is a treatment time in the second nitriding chamber. Note that in the continuous nitriding treatment furnaces A to C, a value calculated by subtracting the nitriding potential KN of the first nitriding chamber from the nitriding potential KN of the second nitriding chamber was −0.1 to 0. Further, the heating chamber and the first nitriding chamber were substantially equal in the nitriding potential KN. Further, in the continuous nitriding treatment furnace D, the heating chamber and the nitriding chamber were substantially equal in the nitriding potential KN. In calculating the nitriding potential KN, "a continuous gas analyzer" (manufactured by ABB, Model AO2000-Uras26) was used for analyzing a $NH_3$ partial pressure, and "a continuous gas analyzer" (manufactured by ABB, Model AO2000-Caldos25) was used for analyzing a $H_2$ partial pressure. Further, as shown in later-described Table 2, in Examples 1 to 7 and Comparative Examples 1 to 3, the process gas for the nitriding treatment is composed of a $NH_3$ gas and a $H_2$ gas, and in Example 8, the process gas for the nitriding treatment is composed of a $NH_3$ gas, a $H_7$ gas, and a $N_2$ gas. Note that, in Example 8, the flow rate of the $N_2$ gas was set to ⅓ of the flow rate of the $H_2$ gas so that a partial pressure ratio of the $NH_3$ gas in the process gas supplied into the first nitriding chamber became 0.1 or more, and the flow rates of the gases included in the process gas were controlled so that the nitriding potential. KN of the first nitriding chamber became 0.65.

After the iron nitride compound layer was formed on the surface of each of the test pieces by the nitriding treatment under the treatment conditions shown in Table 2, the thickness of each of the iron nitride compound layers and a γ' fraction in each of the iron nitride compound layers were measured. Measuring methods of these items are as follows.

[Thickness of Iron Nitride Compound Layer]

The test piece was cut in a direction perpendicular to a worked surface (front surface) with a cutting machine, and its cross section was polished with emery paper, and the polished surface was mirror-finished with a buff. After corroded by a 3% nitric acid alcohol, the aforesaid cross section was observed at 400 magnifications with a metallographic (optical) microscope, and the thickness of the iron nitride compound layer was measured. The iron nitride compound layer, which is also referred to as a white layer, appears white in addition to being different in structure from the base metal, and thus can be easily visually discriminated.

[Measurement of γ' Fraction]

The γ' fracture was measured by EBSP analysis. For the measurement of the γ' fraction, an EBSP (Electron Back Scatter diffraction Pattern) device mounted on FE-SEM (Model: JSM7001F manufactured by JEOL) was used. The EBSP method is a method in which a Kikuchi pattern generated by electron back scattering diffraction when a sample greatly tilted by about 70° is irradiated with an electron beam in a SEM sample chamber is projected onto a phosphor screen, a projected image is taken in by a TV camera or the like, the pattern is indexed, and a crystal orientation at the irradiation point is measured.

In these examples, the test piece was cut in the direction perpendicular to the worked surface (front surface) with a cutting machine, its cross section was polished with emery paper, thereafter mirror-polished with a diamond (grain size 1 μm) buff, and finished by being polished with colloidal silica abrasive grains (grain size 0.05 μm), and the resultant surface was used as a surface to be tested for the analysis. Then, a region of 100 μm in a direction horizontal to a surface layer of the surface to be tested and 20 μm in its depth direction was used as an analysis region, and the Kikuchi pattern in the analysis region was taken in by the EBSP device, an α phase (=Fe), a γ' phase (=$Fe_4N$), and an ε phase (=$Fe_3N$) were selected, and a diffraction surface was indexed.

Thereafter, an analyzing process was performed by a Grain Dilation method using analysis software (OIM Analysis). In the analyzing process, a crystal grain in which two or more adjacent pixels (measurement points) whose orientation difference was within 5° or which was not composed of two or more pixels was not regarded as a crystal grain but was absorbed in an adjacent grain.

Next, Phase MAP in which the α phase, the ε phase, and the γ' phase were separated was created, and a ratio of a sectional area occupied by the γ' phase in the compound layer in the cross section being the surface to be tested of the test piece was calculated as the γ' phase fraction, as expressed by the following expression (1).

$$\gamma' \text{ phase fraction } (\%) = \text{sectional area of the } \gamma' \text{ phase in the iron nitride compound layer/sectional area of the iron nitride compound layer} \times 100 \quad (1)$$

The thickness and the γ' phase fraction of each of the iron nitride compound layers which were measured by the aforesaid methods are as shown in the following Table 2.

TABLE 2

| EXAMPLE/ COMPARATIVE EXAMPLE | FURNACE USED | PROCESS GAS | KN OF FIRST NITRIDING CHAMBER | Temp1 (° C.) | Temp2 (° C.) | Time1 (min) | Time2 (min) | COMPOUND LAYER (μm) | γ' PHASE FRACTION (%) |
|---|---|---|---|---|---|---|---|---|---|
| EXAMPLE 1 | CONTINUOUS NITRIDING TREATMENT FURNACE A | $NH_3$, $H_2$ | 0.65 | 600 | 525 | 60 | 60 | 15 | 33 |
| EXAMPLE 2 | CONTINUOUS NITRIDING TREATMENT FURNACE B | $NH_3$, $H_2$ | 0.65 | 600 | 525 | 60 | 90 | 12 | 76 |
| EXAMPLE 3 | CONTINUOUS NITRIDING TREATMENT FURNACE C | $NH_3$, $H_2$ | 0.65 | 600 | 525 | 60 | 120 | 13 | 86 |
| EXAMPLE 4 | CONTINUOUS NITRIDING TREATMENT FURNACE A | $NH_3$, $H_2$ | 0.65 | 600 | 550 | 60 | 60 | 14 | 41 |
| EXAMPLE 5 | CONTINUOUS NITRIDING TREATMENT FURNACE B | $NH_3$, $H_2$ | 0.65 | 600 | 550 | 60 | 90 | 12 | 66 |
| EXAMPLE 6 | CONTINUOUS NITRIDING TREATMENT FURNACE C | $NH_3$, $H_2$ | 0.80 | 600 | 525 | 60 | 90 | 14 | 31 |
| EXAMPLE 7 | CONTINUOUS NITRIDING TREATMENT FURNACE B | $NH_3$, $H_2$ | 0.50 | 600 | 525 | 60 | 90 | 7 | 88 |
| EXAMPLE 8 | CONTINUOUS NITRIDING TREATMENT FURNACE B | $NH_3$, $H_2$, $N_2$ | 0.65 | 575 | 500 | 60 | 90 | 8 | 70 |
| COMPARATIVE EXAMPLE 1 | CONTINUOUS NITRIDING TREATMENT FURNACE D | $NH_3$, $H_2$ | 0.65 | 600 | — | 60 | — | 14 | 9 |
| COMPARATIVE EXAMPLE 2 | CONTINUOUS NITRIDING TREATMENT FURNACE B | $NH_3$, $H_2$ | 0.65 | 525 | 525 | 60 | 90 | 1 | — |
| COMPARATIVE EXAMPLE 3 | CONTINUOUS NITRIDING TREATMENT FURNACE B | $NH_3$, $H_2$ | 0.65 | 550 | 550 | 60 | 90 | 2 | — |

As is seen from Table 2, in all the cases where the continuous nitriding treatment furnaces A to C were used to execute the nitriding treatment in which the atmosphere gas temperature in the second nitriding chamber was set lower than the atmosphere gas temperature in the first nitriding chamber, a sufficient amount of the γ' phase precipitated in the iron nitride compound layer.

On the other hand, as is seen from Comparative Example 1, in the case where the continuous nitriding treatment furnace D without the second nitriding chamber was used, the γ' phase fraction in the iron nitride compound layer was low because the atmosphere gas temperature in the first nitriding chamber was in an ε-phase stable region. That is, in the continuous nitriding treatment furnace without the second nitriding chamber, it is not possible to obtain a nitrided steel member having desired properties. Further, as is seen from Comparative Example 2, even in the continuous nitriding treatment furnace B including the second nitriding chamber, if the atmosphere gas temperature in the first nitriding chamber is too low, the formation speed of the iron nitride compound layer becomes low, and the thickness of the iron nitride compound layer becomes thin. Further, as is seen from Comparative Examples 2, 3, when the atmosphere gas temperatures in the first nitriding chamber and the second nitriding chamber are not different, the increase in the ratio of the γ' phase cannot be caused in the second nitriding chamber.

It is seen from these examples that, by providing the first nitriding chamber and the second nitriding chamber, allowing the atmosphere gas in the first nitriding chamber to flow into the second nitriding chamber, and setting the atmosphere gas temperature in the second nitriding chamber lower than the atmosphere gas temperature in the first nitriding chamber, it is possible to perform, in the continuous furnace, the nitriding treatment that precipitates the γ' phase in the iron nitride compound layer after forming the iron nitride compound layer.

INDUSTRIAL APPLICABILITY

The present invention is applicable to a nitriding treatment of a steel member.

EXPLANATION OF CODES

1 continuous nitriding treatment furnace
2 carry-in port
3 carry-in door
4 carry-out port
5 carry-out door
6 roller hearth
7*a* partition door
7*b* partition door
8 process gas supply pipe
9 gas analyzer
10 exhaust pipe
11 heater
12 stirring fan
13 roller hearth
20 heating chamber
21 nitriding chamber
21*a* first nitriding chamber
21*b* second nitriding chamber
21*c* first nitriding zone
21*d* second nitriding zone
22 cooling chamber
30 control part
L conveyor line
S steel member

The invention claimed is:

1. A continuous nitriding treatment furnace to apply a nitriding treatment to a steel member, the continuous nitriding treatment furnace comprising:

a nitriding chamber into which the steel member is carried;

a heater that heats an atmosphere gas in the nitriding chamber;

a gas analyzer that measures a partial pressure of the atmosphere gas in the nitriding chamber; and a controller that is configured to control an atmosphere gas temperature in the nitriding chamber, by adjusting a heat value of the heater so as to cause the nitriding chamber to have a first nitriding zone and a second nitriding zone whose atmosphere gas temperatures are different, the second nitriding zone being located downstream of the first nitriding zone in terms of a conveyor line and being lower in the atmosphere gas temperature than the first nitriding zone by 25° C. to 150° C., and that is configured to perform a control of executing the nitriding treatment that forms an iron nitride compound layer on a surface of the steel member in the first nitriding zone, by adjusting flow rates of gases included in a process gas for the nitriding treatment so as to attain a nitriding potential KN with which the iron nitride compound layer composed of an ε phase or of the ε phase and a γ' phase is formed on the surface of the steel member, and precipitates the γ' phase in the iron nitride compound layer in the second nitriding zone, wherein the controller is configured to adjust the flow rates of the gases included in the process gas for the nitriding process based on partial pressures of the gases, and wherein, when the atmosphere gas in the first nitriding zone flows into the second nitriding zone, a value calculated by subtracting the nitriding potential KN of the first nitriding zone from the nitriding potential KN of the second nitriding zone becomes −0.1 to 0.

2. The continuous nitriding treatment furnace according to claim 1, wherein the controller is configured to perform the control of adjusting the heat value so as to cause the atmosphere gas temperature in the first nitriding zone to be 550 to 650° C.

3. The continuous nitriding treatment furnace according to claim 1, wherein the controller is configured to perform the control of adjusting the heat value of the heater so as to cause the atmosphere gas temperature in the second nitriding zone to be 400 to 550° C.

4. The continuous nitriding treatment furnace according to claim 1, wherein the controller is configured to perform the control of adjusting the flow rates of the gases included in the process gas so as to cause the nitriding potential KN of the first nitriding zone to be 0.25 to 1.0.

5. The continuous nitriding treatment furnace according to claim 1, wherein the first nitriding zone and the second nitriding zone are nitriding chambers different from each other.

6. A continuous nitriding treatment furnace to apply a nitriding treatment to a steel member, the continuous nitriding treatment furnace comprising:

a nitriding chamber into which the steel member is carried;

a heater that heats an atmosphere gas in the nitriding chamber; and a controller that is configured to control an atmosphere gas temperature in the nitriding chamber, by adjusting a heat value of the heater so as to cause the nitriding chamber to have a first nitriding zone and a second nitriding zone whose atmosphere gas temperatures are different, the second nitriding zone being located downstream of the first nitriding zone in terms of a conveyor line and being lower in the atmosphere gas temperature than the first nitriding zone by 25° C. to 150° C., and that is configured to perform a control of executing the nitriding treatment that forms an iron nitride compound layer on a surface of the steel member in the first nitriding zone, by adjusting flow rates of gases included in a process gas for the nitriding treatment so as to attain a nitriding potential KN with which the iron nitride compound layer composed of an ε phase or of the ε phase and a γ' phase is formed on the surface of the steel member, and precipitates the γ' phase in the iron nitride compound layer in the second nitriding zone, wherein, when the atmosphere gas in the first nitriding zone flows into the second nitriding zone, a value calculated by subtracting the nitriding potential KN of the first nitriding zone from the nitriding potential KN of the second nitriding zone becomes −0.1 to 0, wherein a process gas supply pipe through which the process gas is supplied to the nitriding chamber connects to the first nitriding zone, and wherein an exhaust pipe through which an atmosphere gas in the furnace is discharged connects to the second nitriding zone.

7. The continuous nitriding treatment furnace according to claim 6, wherein a heating zone for pre-heating the steel member is provided upstream of the first nitriding zone in terms of the conveyor line, and the exhaust pipe is further provided in the heating zone.

8. A continuous nitriding treatment method of using the continuous nitriding treatment furnace according to claim 1 and applying the nitriding treatment to the steel member in the continuous nitriding treatment furnace, the method comprising:

controlling the atmosphere gas temperature in the nitriding chamber into which the steel member is carried, so as to cause the nitriding chamber to have the first nitriding zone and the second nitriding zone whose atmosphere gas temperatures are different, the second nitriding zone being located downstream of the first nitriding zone in terms of the conveyor line and being lower in the atmosphere gas temperature than the first nitriding zone by 25° C. to 150° C.; and performing the nitriding treatment that:

forms the iron nitride compound layer on the surface of the steel member in the first nitriding zone to which the process gas for the nitriding treatment has been supplied, with the gases included in the process gas being adjusted in the flow rates so as to attain the nitriding potential KN with which the iron nitride compound layer composed of the ε phase or of the ε phase and a γ' phase is formed on the surface of the steel member, and precipitates the γ' phase in the iron nitride compound layer in the second nitriding zone, configured such that the value calculated by subtracting the nitriding potential KN of the first nitriding zone from the nitriding potential KN of the second nitriding zone becomes −0.1 to 0 when the atmosphere gas in the first nitriding zone flows into the second nitriding zone.

9. The continuous nitriding treatment method according to claim 8, wherein the atmosphere gas temperature in the first nitriding zone is set to 550 to 650° C.

10. The continuous nitriding treatment method according to claim 8, wherein the atmosphere gas temperature in the second nitriding zone is set to 400 to 550° C.

11. The continuous nitriding treatment method according to claim 8, wherein the nitriding potential KN of the first nitriding zone is set to 0.25 to 1.0.

12. The continuous nitriding treatment method according to claim 8, wherein the treatments executed in the first nitriding zone and the second nitriding zone are performed in different nitriding chambers.

13. The continuous nitriding treatment method according to claim 8, wherein the process gas is supplied to the first nitriding zone, and an atmosphere gas in the furnace is discharged in the second nitriding zone.

14. The continuous nitriding treatment method according to claim 13, wherein a heating zone for pre-heating the steel member is provided upstream of the first nitriding zone in terms of the conveyor line, and the atmosphere gas in the furnace is discharged also in the heating zone.

* * * * *